US011913321B2

(12) United States Patent
Ejim

(10) Patent No.: US 11,913,321 B2
(45) Date of Patent: Feb. 27, 2024

(54) DOWNHOLE GAS-LIQUID SEPARATOR

(71) Applicant: SAUDI ARABIAN OIL COMPANY, Dhahran (SA)

(72) Inventor: Chidirim Enoch Ejim, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 5 days.

(21) Appl. No.: 17/648,274

(22) Filed: Jan. 18, 2022

(65) Prior Publication Data

US 2023/0228180 A1 Jul. 20, 2023

(51) Int. Cl.
*E21B 43/38* (2006.01)

(52) U.S. Cl.
CPC ..... *E21B 43/38* (2013.01)

(58) Field of Classification Search
CPC ..... E21B 43/12; E21B 43/40; E21B 43/34; E21B 43/38; E21B 43/121; E21B 43/122; E21B 43/123
See application file for complete search history.

(56) References Cited

U.S. PATENT DOCUMENTS 1,674,815 A * 6/1928 Barnhart ..... E21B 43/121 166/265
7,461,692 B1 12/2008 Wang
2013/0032341 A1* 2/2013 Raglin ..... E21B 43/38 166/265
2015/0068741 A1 3/2015 Schultz
2017/0266586 A1 9/2017 Hopper
2020/0080408 A1 3/2020 McCoy
2020/0362649 A1* 11/2020 Brown ..... B01D 19/0057

FOREIGN PATENT DOCUMENTS

CN 113187460 A 7/2021

OTHER PUBLICATIONS

Sharma, Ashutosh et al., "Experimental Evaluation of a Prototype Centrifugal Packer-Type Downhole Separator", SPE-201147-MS, paper presented at the SPE Artificial Lift Conference and Exhibition—Americas, Virtual, Nov. 2020 (14 pages).
L. Enrique Ortiz-Vidal et al., "High efficiency gas-liquid separation system for pumped wells", KeAi Communications Co., Ltd., Petroleum, vol. 5, Issue 2, Jun. 2019, pp. 178-182 (5 pages).
Jyothi Swaroop Samayamantula, "An Innovative Design For Downhole Gas Separation", Don-Nan Pump & Supply Co., Inc. (9 pages).
"VGSA Vortex gas separator assembly", Schlumberger, 2016, URL: <https://www.slb.com/-/media/files/al/product-sheet/vgsa-vortex-gas-separator-ps.ashx> (2 pages).

* cited by examiner

*Primary Examiner* — Abby J Flynn
*Assistant Examiner* — Yanick A Akaragwe
(74) *Attorney, Agent, or Firm* — Osha Bergman Watanabe & Burton LLP

(57) ABSTRACT

An apparatus for gas-liquid separation includes a first separation region that receives a mixture of liquids and gases, at least a portion of the first separation region forms a conical section; a second separation region that receives liquids and gases from the first separation region; and a cross-over section fluidly connecting the second separation region to a tubing.

10 Claims, 4 Drawing Sheets

DOWNHOLE GAS-LIQUID SEPARATOR

BACKGROUND

For oil and gas drilling and production from subterranean reservoirs, long horizontal wells are commonly used to ensure maximum reservoir contact. Wellbore fluids from the formation often contain a combination of liquids and gas, yet a majority of wells do not have sufficient formation pressure to drive the wellbore fluids to the surface. Therefore, some wells may be fitted with an artificial lift system to facilitate liquids and gas production. Because most artificial lift systems are primarily designed to recover liquids, excess amounts of gas may be detrimental to the performance of the artificial lift system. A pump is an example of an artificial lift system to leverage wellbore fluids to the surface. But if the wellbore fluids include an excess amount of gases, the operation of the pump may be impeded by displacement of the liquids in the pump. This not only reduces the amount of liquid production, but also causes damage to the equipment.

The industry has developed a wide variety of devices, such as a gas-liquid separator, and techniques to separate the gas from the liquids. It is highly desirable to have a simple, effective, and reliable method and apparatus for downhole gas separation, both efficiently and economically.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to an apparatus for gas-liquid separation comprising: a first separation region that receives a mixture of liquids and gases, at least a portion of the first separation region forms a conical section; a second separation region that receives liquids and gases from the first separation region; and a cross-over section fluidly connecting the second separation region to a tubing.

In one or more embodiments, the first separation region comprises: an inlet that receives the mixture of liquids and gases; and an outlet having a radius smaller than a radius of the inlet. The second separation region receives liquids and gases from the outlet. In one or more embodiments, the inlet comprises one or more guide vanes to provide the mixture of liquids and gases a velocity at a tangential direction. In one or more embodiments, liquids and gases swirl and separate in the first separation region, and travel toward opposite ends of the second separation region under gravity. In one or more embodiments, the apparatus further comprises a pump disposed inside the tubing and configured to leverage liquids in the second separation region through the cross-over section.

In another aspect, embodiments disclosed herein relate to a system comprising a gas-liquid separator and a production tubing, both disposed in a casing. The gas-liquid separator comprises a swirl enhancer that receives a mixture of liquids and gases, at least a portion of the swirl enhancer forms a conical section; a collector that receives liquids and gases from the swirl enhancer; and a cross-over section fluidly connecting the collector to a production tubing.

In one or more embodiments, the swirl enhancer comprises: an inlet that receives the mixture of liquids and gases; and an outlet having a radius smaller than a radius of the inlet. The collector receives liquids and gases from the outlet. In one or more embodiments, the system further comprises a tubing-casing annulus formed between the production tubing and the casing that connects the gas-liquid separator to surface. In one or more embodiments, the system further comprises a pump disposed in the production tubing and is operable to leverage liquids from the cross-over section to surface. In one or more embodiments, a diameter of the gas-liquid separator occupies almost an entire diameter of the casing.

In another aspect, embodiments disclosed herein relate to a method comprising: disposing a gas-liquid separator and a production tubing in a casing, wherein the gas-liquid separator comprises a swirl enhancer, a collector, and a cross-over section; receiving a wellbore fluid containing liquids and gases through the swirl enhancer; separating liquids and gases in the swirl enhancer under centrifugal effect; further separating liquids and gases toward different ends of the collector under gravity; and directing the liquids from the collector to the production tubing through a cross-over section.

In one or more embodiments, the method further comprises leveraging liquids to surface through a pump in the production tubing. In one or more embodiments, when receiving the wellbore fluid containing liquids and gases through the swirl enhancer, an inlet of the swirl enhancer provides a velocity at a tangential direction to the wellbore fluid.

The foregoing general description and the following detailed description are exemplary of the invention and are intended to provide an overview or framework for understanding the nature of the invention as it is claimed. The accompanying drawings are included to provide further understanding of the invention and are incorporated in and constitute a part of the specification. The drawings illustrate various embodiments of the invention and together with the description serve to explain the principles and operation of the invention.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
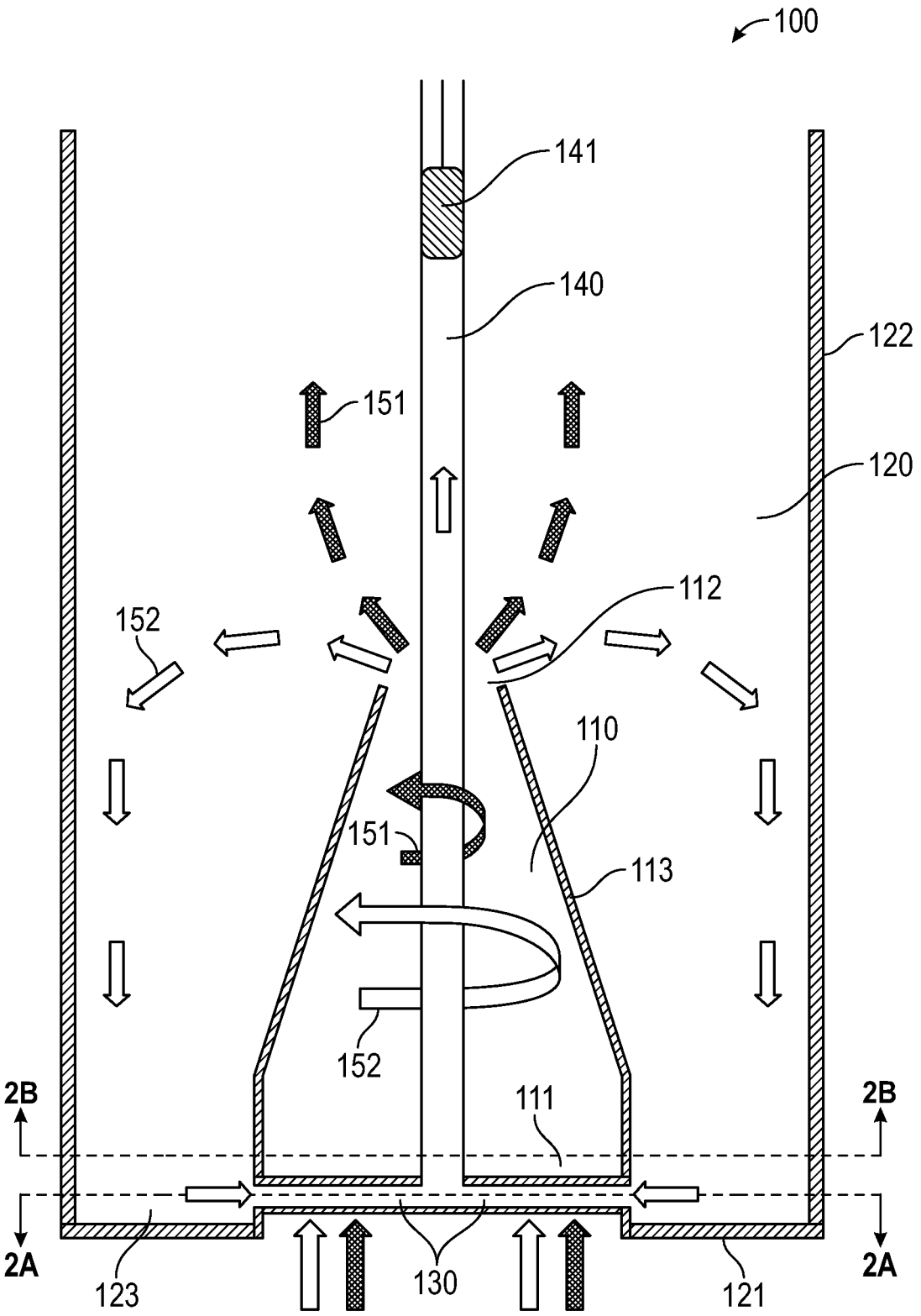
FIG. 1 is a cross-sectional view of a gas-liquid separator according to one or more embodiments.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. In other instances, related well known features or processes have not been shown or described in detail to avoid unnecessarily obscuring the implementations and embodiments. For the sake of continuity, and in the interest of conciseness, same or similar reference characters may be used for same or similar objects or features in multiple figures.

System, method, and apparatus for separating gases and liquids are described herein. The system, method, and apparatus effectively separate gases and liquids in wellbore fluids. The system, method, and apparatus may provide a benefit of facilitating efficient production operation and increasing system reliability, especially in long horizontal wells. The system, method, and apparatus also advantageously eliminate the need for external power supply and provide minimal number of components and simplicity.

In the following description, the terms "up," "down," "top," and "bottom," unless otherwise specified, refer to directions and/or orientations assuming that the "up" and the "top" are directions vertically toward the surface for a wellbore, and the "down" and the "bottom" are directions vertically toward downhole.

FIG. 1 shows one illustrative implementation of a gas-liquid separator 100 that may be used in a wellbore to separate liquids, such as oil and water, and gases (e.g., hydrocarbon, $CO_2$, etc.) in wellbore fluids. The gas-liquid separator 100 may include a swirl enhancer 110, a collector 120, and a cross-over section 130. A production tubing 140 may be disposed inside the gas-liquid separator and connects the gas-liquid separator 100 to surface. The production tubing 140 may be a tubular section that traverses the cross-over section 130 at a bottom end of the production tubing 140 and extends upward to the surface. An artificial lift system may be disposed in the wellbore to add energy to wellbore fluids to leverage at least one component from the wellbore fluids to the surface. A pump 141 is an example of the artificial lift system. The pump 141 may be a positive displacement pump, centrifugal pump, or other type of pump that may be applicable. The pump may be disposed in a production tubing 140. The swirl enhancer 110 may be a conical section disposed to an outer periphery of the production tubing 140 and inside the collector 120. The swirl enhancer may comprise an inlet 111 exposed to wellbore fluids and an outlet 112 exposed to the collector 120. The collector 120 may be disposed outside the swirl enhancer 110 and the production tubing 140. The collector 120 is fluidly connected to the production tubing 140 through the cross-over section 130. The collector 120 may have a height that is larger than a height of the swirl enhancer 110. The cross-over section 130 may be disposed near a height of the inlet 111 of the swirl enhancer 110, such that the wellbore fluids may flow past the cross-over section 130 when entering the swirl enhancer 110. The cross-over section 130 fluidly connects the collector 120 and the production tubing 140. Flow directions of the liquids and the gases in the gas-liquid separator 100 are also shown in FIG. 1, represented by hollow arrows 152 and shaded arrows 151, respectively.

According to one or more embodiments of the present invention, the swirl enhancer 110 comprises the inlet 111, the outlet 112, and a side wall 113. The inlet 111 may be disposed at a bottom end of the swirl enhancer 110 and the outlet 112 may be disposed at a top end of the swirl enhancer 110. The inlet 111 is an opening that provides entry of the wellbore fluids, under formation pressure, into the gas-liquid separator 100. In one or more embodiments, the inlet 111 of the swirl enhancer 110 may be shaped or may comprise guide vanes to redirect the wellbore fluids entering the inlet 111 with a tangential velocity. The tangential velocity is defined as a tangential direction component of a swirl velocity v, at which the wellbore fluids travel. A radius of the inlet $r_{in}$ is defined as a closest distance between the bottom end of the swirl enhancer 110 and the production tubing 140. A radius of the outlet $r_{out}$ is defined as a closest distance between the top end of the swirl enhancer 110 and the production tubing 140. The radius of the inlet $r_{in}$ is larger than the radius of the outlet $r_{out}$. In one or more embodiments, a ratio of $r_{in}$ versus $r_{out}$ may be more than 1, or more than 1.5, or more than 2, or more than 3. As a result, at least a portion of the side wall 113 may have a cone shape, providing a conical section of the swirl enhancer 110. The remaining of the swirl enhancer 110 may have a cylinder shape.

The wellbore fluids, with the tangential velocity, may travel in a spiral pathway inside the swirl enhancer. That is, the swirl enhancer may serve as a centrifuge, where matter with larger density and larger particle size travel at a higher rate and at some point, may be separated from particles less dense or smaller. As a result, the liquids may tend to swirl near the side wall 113 of the swirl enhancer 110, as indicated by the hollow arrow in the swirl enhancer. On the other hand, the gases may swirl closer to the production tubing 140, as indicated by the shaded arrow in the swirl enhancer. As the wellbore fluids travel from the inlet 111 toward the outlet 112 of the swirl enhancer, the radius may decrease at the conical section. Based on law of conservation of angular momentum, when radius decreases, a tangential velocity $v_{tan}$ may increase. The swirl velocity may also increase as a result. For a given radius, a relative centrifugal force is proportional to the square of the tangential velocity. Therefore, the difference in densities of gases and liquids, together with the increased tangential velocity and swirl velocity, may result in a more efficient separation of the liquids and the gases. At the moment that wellbore fluids exit the outlet 112, the liquids and the gases may remain along their travelling pathway due to inertia and may have different trajectory pathways. Due to density differences between liquids and gases, the liquids with higher density may tend to travel radially more outwards than the gases with lower density.

According to one or more embodiments of the present invention, the collector 120 may be disposed outside the swirl enhancer 110 and receives liquids and gases from the outlet 112 of the swirl enhancer. The collector 120 may comprise a bottom 121 and an outer wall 122, which extends upwards from the bottom 121 to a height that is higher than the outlet 112 of the swirl enhancer 110. The collector 120 may have any desired shape, for example, a cylinder shape. Liquids and gases that are initially separated in the swirl enhancer 110 may further separate in the collector 120 under gravity effect. The gases may expand in the collector 120 and continue to flow upwards. On the other hand, liquids exiting the outlet 112 may be ejected radially outwards toward the outer wall 122 of the collector 120, subsequently fall downwards toward the bottom 121 under gravity, forming a liquid rich region 123.

According to one or more embodiments disclosed herein the cross-over section 130 may be disposed near the bottom 121 of the collector 120 and provide a liquid flow pathway between the collector 120 and the production tubing 140.

The cross-over section 130 may be composed of one or more flow pathways, such that liquids settled to the liquid rich region 123 of the collector 120 may flow to the production tubing 140 through the one or more flow pathways. In one or more embodiments, the cross-over section 130 may be disposed horizontally or may be slightly tilted with an end connected to the production tubing 140 slightly higher than the other end connected to the collector 120, or the end connected to the production tubing 140 slightly lower than the other end connected to the collector 120.

Figure 2A:
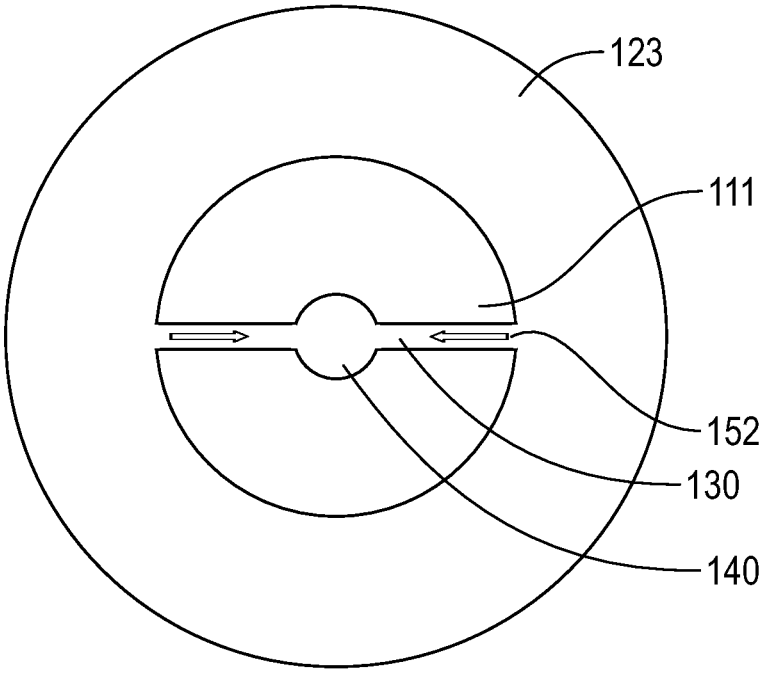
FIG. 2A is a cross-sectional view of a gas-liquid separator according to one or more embodiments, along a 2A reference line in FIG. 1.

FIG. 2A shows a cross-sectional view of the gas-liquid separator according to one or more embodiments. The cross-sectional view is obtained along a 2A reference line shown in FIG. 1, at a height of the cross-over section 130. At such height, the wellbore fluids may flow past the cross-over section 130 when entering the inlet 111 of the swirl enhancer. The collector may have a liquid rich region 123 where separated liquids settle under gravity. The cross-over section 130 may comprise one or more of the flow pathways, where an example of two flow pathways is shown in FIG. 2A. The two flow pathways are horizontally disposed and fluidly connect the liquid rich region 123 of the collector to the production tubing 140. Liquids, represented by hollow arrows 152, flow from the liquid rich region 123 through the cross-over section 130 to the production tubing 140.

Figure 2B:
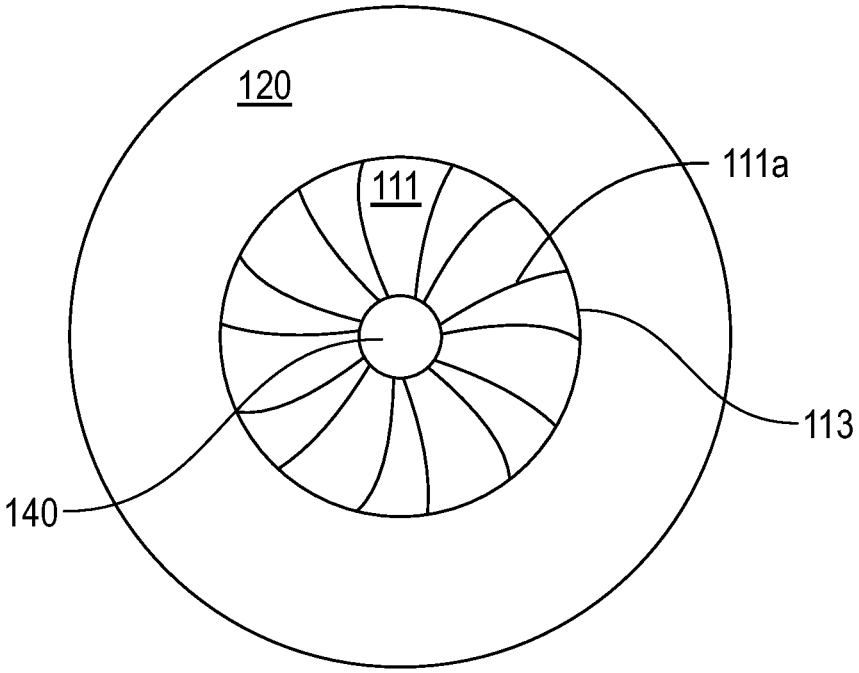
FIG. 2B is a cross-sectional view of a gas-liquid separator according to one or more embodiments, along a 2B reference line in FIG. 1.

FIG. 2B shows a cross-sectional view of the gas-liquid separator according to one or more embodiments. The cross-sectional view is obtained along a 2B reference line shown in FIG. 1, at a height of one or more guide vanes 111*a*. The guide vanes 111*a* at the inlet 111 of the swirl enhancer may be disposed above the cross-over section (not shown in FIG. 2B), such that the wellbore fluids may flow past the cross-over section when entering inlet 111 of the swirl enhancer. The guide vanes may be fixed to an outside of the production tubing 140, or to an inside of the side wall 113 of the swirl enhancer, or both. The guide vanes 111*a* may have a tilted angle such that the wellbore fluids may enter the swirl enhancer at an angle, providing a tangential velocity such that the wellbore fluids travel spirally in the swirl enhancer. While a fan shape is shown as an example in FIG. 2B, the guide vanes 111*a* may have any shape of interest, as long as it provides a tangential velocity. The number of guide vanes may be one, or two, or more.

Retuning to FIG. 1, the production tubing 140 according to one or more embodiments may be disposed at a center axis of the gas-liquid separator, and the swirl enhancer 110 and the collector 120 may be disposed outside the production tubing 140. The production tubing 140 may fluidly connect to the cross-over section 130 at the liquid rich region 123, where liquids from the collector 120 may flow to the production tubing 140 through the cross-over section 130. The pump 141 in the production tubing 140 may be used to leverage the liquids to the surface.

Shaded arrows 151 and hollow arrows 152 in FIG. 1 represent flow directions of the gases and the liquids in the wellbore fluids, respectively. According to one or more embodiments, the liquids and the gases both enter the swirl enhancer 110 through the inlet 111 with at least a tangential velocity. The swirl enhancer 110 serves as a centrifuge, where liquids, having larger density and larger particle size, may separate from the gases, having lower density and smaller particle size, as travelling spirally upwards in the swirl enhancer 110. Due to a conical shape of at least a portion of the swirl enhancer 110, as the liquids and the gases travel upwards toward the outlet 112 of the swirl enhancer 110, the tangential velocity of the liquids and gases may increase, leading to a more efficient separation. At the outlet 112 of the swirl enhancer, the liquids may be ejected more outwards than the gases toward the outer wall of the collector 120. In the collector 120, the gases may flow upwards, whereas the liquids may settle to the liquid rich region 123 near the bottom 121 of the collector 120, under the effect of gravity. The settled liquids may flow through the cross-over section 130 into the production tubing 140, where a pump 141 may be used to leverage the liquids to the surface.

The gas-liquid separator of this disclosure utilizes both centrifugal forces and gravity to separate liquids and gases, both efficiently and effectively. The wellbore fluids enter the gas-liquid separator under sufficient formation pressure. The swirl enhancer provides efficient centrifugal effects for initial separation and the collector enables further separation under gravity. The dual mechanisms production operation using the gas-liquid separator disclosed herein enable more efficient separation than conventional separators based on gravity only (e.g., a Don-Non separator). Further, the gas-liquid separator discloses herein advantageously eliminate the need for external power supply and provide minimal number of components and simplicity.

Figure 3:
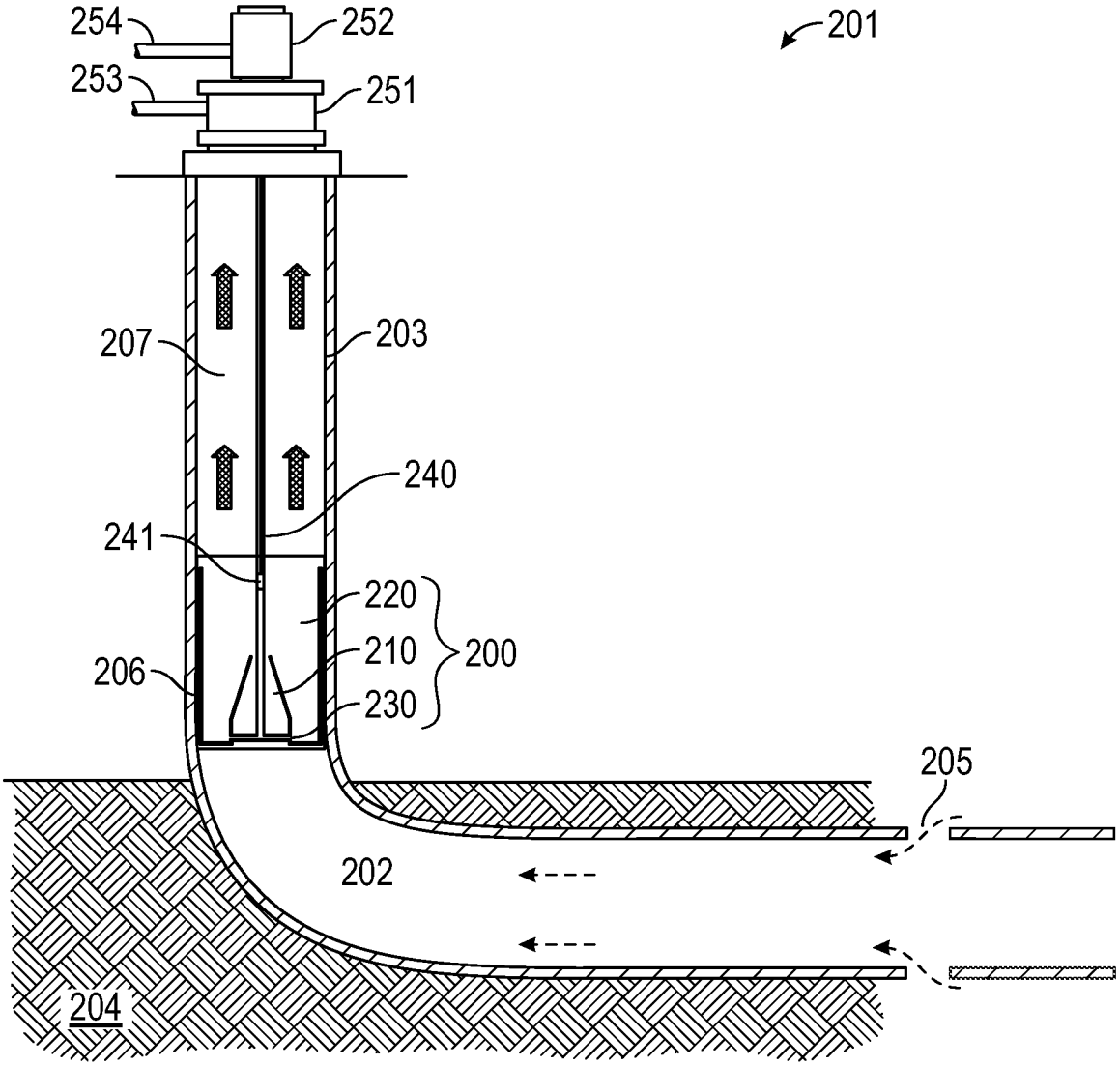
FIG. 3 is a schematic view of a system according to one or more embodiments, including a gas-liquid separator.

FIG. 3 shows an exemplary system 201 according to one or more embodiments for separating gases and liquids in wellbore fluids. A wellbore 202 may traverse a reservoir 204, which may be a hydrocarbon bearing reservoir. The wellbore fluids may include, for example, liquids containing oil and water, and gases. One or more casing 203 may be installed in the wellbore 202. The number of casings illustrated is not intended to be limiting. The casing 203 may extend to a top of the wellbore or may be a liner which does not extend to the top of the wellbore. The casing 203 may extend into the reservoir 204 and may include perforations or wall openings (not shown separately) 205 to allow wellbore fluids to enter into the wellbore 202. An artificial lift system may be disposed in the wellbore 202 to add energy to wellbore fluids or leverage the energy of the wellbore fluids to leverage at least one component from the wellbore fluids to the surface. A pump 241 is an example of the artificial lift system. The pump 241 may be a positive displacement pump, centrifugal pump, or other type of pump that may be applicable. The pump may be disposed in a production tubing 240.

According to one or more embodiments, a gas-liquid separator 200 may be disposed within the casing 203. The gas-liquid separator 200 may be disposed at any position along a vertical section of the wellbore 202. In one or more embodiments, the gas-liquid separator 200 may be disposed deep close to an inclined section of the wellbore 202 to facilitate a rich supply of wellbore fluids. A diameter of the gas-liquid separator 200 may occupy almost an entire diameter of the casing 203. In other words, a separator-casing annulus 206 formed between the gas-liquid separator 200 and the casing 203 may be minimized, such that wellbore fluids, including liquids and gases, may preferentially flow inside the gas-liquid separator 200 rather than flow through the separator-casing annulus 206. Even if a small amount of liquids and gases may flow through the separator-casing annulus 206, high frictional resistance may impede their velocities. A tubing-casing annulus 207 may be formed between the production tubing 240 and the casing 203. The tubing-casing annulus 207 may be fluidly connected to the separator-casing annulus 206.

During production operation, the wellbore fluids (flow direction shown as dash arrows), comprising any combination of liquids and gases, may enter the casing 203 through the wall openings 205. Sufficient formation energy may drive the wellbore fluids into the gas-liquid separator 200. The gas-liquid separator 200 may comprise a swirl enhancer 210, a collector 220, and a cross-over section 230. An inlet of the swirl enhancer 210 receives the wellbore fluids and may be shaped or may comprise guide vanes to provide a tangential velocity to the wellbore fluids. The cross-over section 230 may be disposed near a height of the inlet of the swirl enhancer, such that the wellbore fluids may flow past the cross-over section when entering the swirl enhancer 210. The swirl enhancer 210 may be larger in radius at the inlet and smaller in radius at an outlet, thus at least a portion of the swirl enhancer 210 forms a conical section. The wellbore fluids containing liquids and gases may travel spirally upwards in the swirl enhancer 210, and due to density and particle size differences, the liquids may separate from the gases under centrifugal forces. As the wellbore fluids travel spirally upwards, the radius may decrease at the conical section. Based on law of conservation of angular momentum, when radius decreases, a tangential velocity $v_{tan}$ may increase. The swirl velocity may also increase as a result. For a given radius, a relative centrifugal force is proportional to the square of the tangential velocity. Therefore, the difference in densities of gases and liquids, together with the increased tangential velocity and swirl velocity, may result in a more efficient separation of the liquids and the gases. At the moment that wellbore fluids exit the swirl enhancer 210 into the collector 220, the liquids and the gases may remain along their travelling pathway due to inertia and may have different trajectory pathways. Due to density differences between liquids and gases, the liquids may tend to travel radially more outwards than the gases. The collector 220 may receive the liquids and gases from the swirl enhancer, where the gases rise upwards in the collector 220 due to low density and the liquids settle and accumulate in a liquid rich region of the collector 220. The gases (flow direction shown as shaded arrows) may eventually exit the gas-liquid separator 200 through the tubing-casing annulus 207 to a wellhead 251 at surface. The gases may be subsequently gathered and transported via a surface flowline 253 to processing plants. The liquids exiting the swirl enhancer 210 may settle under gravity in the collector 220. The cross-over section fluidly connects the collector 220 to a production tubing 240, where an artificial lift system, such as a pump 241, may be operated to leverage the liquids to the surface. At the surface, the liquids may enter a pumping tee 252 mounted on the wellhead 251 and flow into a second surface flowline 254 through a side outlet of the pumping tee 252. In one or more embodiments, the system disclosed herein may include a surface choke to control a flow rate and pressure of the production. The surface choke may be installed at the wellhead 251.

Figure 4:
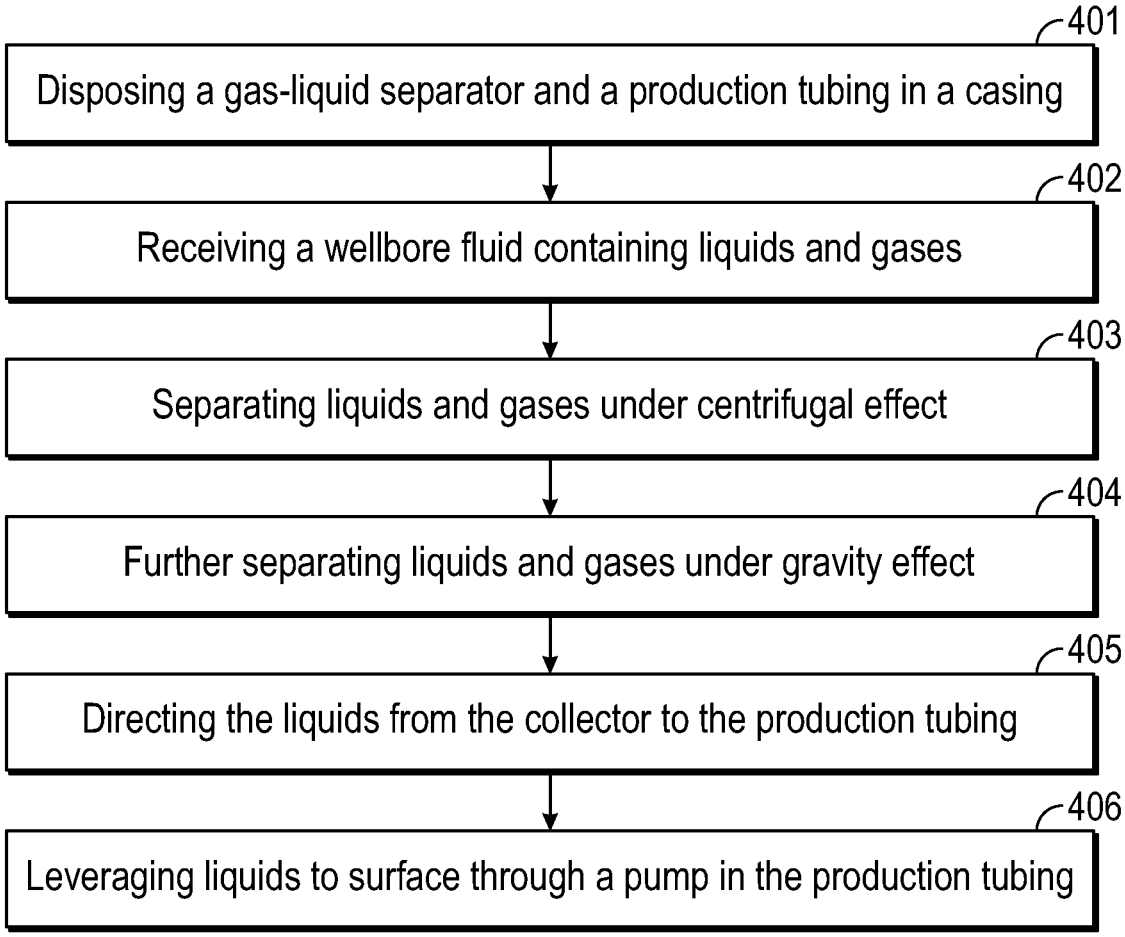
FIG. 4 shows a flowchart for separating liquids and gases according to one or more embodiments.

FIG. 4 shows a method of separating liquids and gases in a wellbore according to one or more embodiments. In step 401, a gas-liquid separator and a production tubing may be disposed into a casing in a wellbore. The gas-liquid separator comprises a swirl enhancer, a collector, and a cross-over section. The casing may extend into the reservoir for production operation. In step 402, wellbore fluids, containing liquids and gases, may enter the gas-liquid separator through an inlet of the swirl enhancer. The inlet may be shaped or may contain guide vanes to provide wellbore fluids a tangential velocity when entering the swirl enhancer. At least a portion of the swirl enhancer may form a conical section. The remaining portion of the swirl enhancer may have a cylinder shape. The wellbore fluids may swirl inside the swirl enhancer, which functions as a centrifuge, such that in step 403, liquids and gases may separate under centrifugal effect. Both liquids and gases may exit the swirl enhancer through an outlet and enter the collector, where liquids and gases are further separated under gravity, as shown in step 404. Liquids may settle to a liquid-rich region in the collector, whereas gases may rise upwards. In step 405, the cross-over section may direct liquids from the liquid-rich region of the collector to the production tubing. In step 406, an artificial lift system may be used to leverage the liquids to surface. A pump is an example of the artificial lift system and may pump the liquids in the production tubing to the surface. Both gases that rise to the surface and liquids that are pumped to the surface may be directed to surface flowlines for further processing.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

The detailed description along with the summary and abstract are not intended to be exhaustive or to limit the embodiments to the precise forms described. Although specific embodiments, implementations, and examples are described herein for illustrative purposes, various equivalent modifications can be made without departing from the spirit and scope of the disclosure, as will be recognized by those skilled in the relevant art.

What is claimed:

1. An apparatus for gas-liquid separation comprising:

a first separation region that receives a mixture of liquids and gases, at least a portion of the first separation region forms a conical section;

a second separation region that receives liquids and gases from the first separation region; and a cross-over section disposed below the first separation region and fluidly connecting the second separation region to a tubing, wherein the first separation region is disposed to an outer periphery of the tubing and inside the second separation region, the first separation region comprises:

an inlet that receives the mixture of liquids and gases and comprises one or more guide vanes to provide the mixture of liquids and gases with a velocity in a tangential direction;

the conical section having a radius that gradually decreases from bottom to top of the conical section, such that a tangential velocity of liquids increases at a different level from a tangential velocity of gases, due to difference between a density of liquids and a density of gases; and an outlet at the top of the conical section having a radius smaller than a radius of the inlet, and the second separation region receives liquids and gases from the outlet.

2. The apparatus of claim 1, wherein liquids and gases swirl and separate in the first separation region.

3. The apparatus of claim 1, wherein liquids and gas travel toward opposite ends of the second separation region under gravity.

4. The apparatus of claim 1, further comprises a pump disposed in the tubing and configured to leverage liquids in the second separation region through the cross-over section.

5. A system comprising:

a gas-liquid separator and a production tubing, both disposed in a casing;

wherein the gas-liquid separator comprises:

a swirl enhancer that receives a mixture of liquids and gases, at least a portion of the swirl enhancer forms a conical section;

a collector that receives liquids and gases from the swirl enhancer; and a cross-over section disposed below the swirl enhancer and fluidly connecting the collector to the production tubing, wherein the swirl enhancer is disposed to an outer periphery of the production tubing and inside the collector, the swirl enhancer comprises:

an inlet that receives the mixture of liquids and gases and comprises one or more guide vanes to provide the mixture of liquids and gases with a velocity in a tangential direction;

the conical section having a radius that gradually decreases from bottom to top of the conical section, such that a tangential velocity of liquids increases at a different level from a tangential velocity of gases, due to difference between a density of liquids and a density of gases; and an outlet at the top of the conical section having a radius smaller than a radius of the inlet, and the collector receives liquids and gases from the outlet.

6. The system of claim 5, further comprises a tubing-casing annulus formed between the production tubing and the casing that connects the gas-liquid separator to surface.

7. The system of claim 5, further comprises a pump disposed in the production tubing and is operable to leverage liquids from the cross-over section to surface.

8. The system of claim 5, wherein a diameter of the gas-liquid separator occupies substantially an entire diameter of the casing.

9. A method comprising:

disposing a gas-liquid separator and a production tubing in a casing, wherein the gas-liquid separator comprises a swirl enhancer, a collector, and a cross-over section disposed below the swirl enhancer;

receiving a wellbore fluid containing liquids and gases through the swirl enhancer;

wherein the swirl enhancer is disposed to an outer periphery of the production tubing and inside the collector, the swirl enhancer comprises:

an inlet that receives the wellbore fluid containing liquids and gases and comprises one or more guide vanes to provide the wellbore fluid containing liquids and gases with a velocity in a tangential direction;

a conical section having a radius that gradually decreases from bottom to top of the conical section, such that a tangential velocity of liquids increases at a different level from a tangential velocity of gases, due to difference between a density of liquids and a density of gases; and an outlet at the top of the conical section having a radius smaller than a radius of the inlet, and separating liquids and gases in the swirl enhancer under centrifugal effect;

further separating liquids and gases toward different ends of the collector under gravity; and directing the liquids from the collector to the production tubing through the cross-over section.

10. The method of claim 9, further comprising leveraging liquids to surface through a pump in the production tubing.

* * * * *